US010053281B2

(12) United States Patent
Wang et al.

(10) Patent No.: US 10,053,281 B2
(45) Date of Patent: Aug. 21, 2018

(54) FOLDING CARGO CONTAINER

(71) Applicants: Guangwei Wang, Fijan (CN); Zhoumin Ni, New York, NY (US)

(72) Inventors: Guangwei Wang, Fijan (CN); Zhoumin Ni, New York, NY (US)

( * ) Notice: Subject to any disclaimer, the term of this patent is extended or adjusted under 35 U.S.C. 154(b) by 149 days.

(21) Appl. No.: 15/292,356

(22) Filed: Oct. 13, 2016

(65) Prior Publication Data

US 2017/0107049 A1 Apr. 20, 2017

(30) Foreign Application Priority Data

Oct. 14, 2015 (CN) ..... 2015 2 0792017

(51) Int. Cl.
*B65D 88/52* (2006.01)
*B65D 88/12* (2006.01)
*B65D 90/08* (2006.01)

(52) U.S. Cl.
CPC ..... *B65D 88/522* (2013.01); *B65D 88/12* (2013.01); *B65D 90/08* (2013.01)

(58) Field of Classification Search
CPC ..... B65D 88/522; B65D 88/12; B65D 90/08; B65D 88/52; B65D 7/26; B65D 7/14; B65D 7/24
USPC ..... 220/7, 1.5; 312/108, 258, 262; 211/195
See application file for complete search history.

(56) References Cited

U.S. PATENT DOCUMENTS 3,529,741 A * 9/1970 Tabron ..... B65D 7/26 220/1.5
4,295,431 A * 10/1981 Stavlo ..... B65D 19/08 108/55.1
2002/0121493 A1* 9/2002 Wang ..... A47F 7/19 211/195

* cited by examiner

*Primary Examiner* — Stephen Castellano
(74) *Attorney, Agent, or Firm* — Weitzman Law Offices, LLC

(57) ABSTRACT

A folding cargo container is disclosed. The folding cargo container has a left frame, a right frame, a rear frame, a bottom frame, a cross bar, a first connection member, a second connection member, and a third connection member, the left frame is foldably connected to the rear frame via the first connection member, the right frame is foldably connected to the rear frame via the second connection member, the left end of the bottom frame is foldably connected to the left frame via the third connection member. Locking slots can lock the bottom frame and right frame. The described cargo container has a simple structure and low production cost, and all frame parts thereof may be folded together, which takes up less space when not in use.

11 Claims, 2 Drawing Sheets

FOLDING CARGO CONTAINER

FIELD OF THE INVENTION

The present application relates to containers, and, more particularly to cargo containers.

BACKGROUND

During a production process, a production workshop requires transport of a variety of raw materials, semi-finished products and finished products, and therefore would use warehouse carts and transport containers to move them. Most existing transport containers have an iron structure, which is complex to produce and has a high cost. They are also heavy, cumbersome, and occupy a large space when not in use.

SUMMARY

As a result, there is a need for a transport container that is lightweight, has a simple structure, is easy to manufacture, and has a small footprint but large cargo space.

The instant disclosure describes a folding cargo container which addresses the defects of a transport container according to the prior art.

One aspect involves a folding cargo container, comprising a left frame, a right frame, a rear frame, a bottom frame, a cross bar, a first connection member, a second connection member, and a third connection member, the left frame is foldably connected to the rear frame via the first connection member, the right frame is foldably connected to the rear frame via the second connection member, the left end of the bottom frame is foldably connected to the left frame via the third connection member, one end of the bottom frame is formed to connect with locking slots, the locking slots lock the bottom frame to the rail on the bottom of the right frame, the left end of the cross bar is rotatably connected to the left frame, the right end of the cross bar is provided with a latching slot, and the right frame is provided with a latching pin for engagement with the latching slot.

With another aspect, the first connection member, the second connection member, and the third connection member of the cargo container are hinges.

Yet another aspect of the cargo container involves a top frame, and the top frame is foldably connected to the left frame or the right frame.

Furthermore, with another alternative aspect, the left end of the cross bar is rotatably connected to a front vertical rod of the left frame, and the latching pin is disposed on the front vertical rod of the right frame.

The present disclosed embodiments have the following advantages. Cargo containers, as described herein, that comprise a left frame, a right frame, a rear frame, a bottom frame, a cross bar, and first, second, and third connection members, have a structure that is simple, and has low production cost.

Additionally, since the bottom frame may be folded to the left frame by rotating by 90 degrees via the third connection member, the left frame may be folded to the rear frame by rotating by 90 degrees via the first connection member, and the right frame may be folded to the rear frame by rotating by 90 degrees via the second connection member, the cargo container may be folded when not in use to occupy a small space.

Moreover, embodiments of the claimed cargo container may be entirely made of aluminum alloy to be lightweight.

The foregoing and following outlines rather generally the features and technical advantages of one or more embodiments of this disclosure in order that the following detailed description may be better understood. Additional features and advantages of this disclosure will be described hereinafter, which may form the subject of the claims of this application.

DETAILED DESCRIPTION

Figure 1:
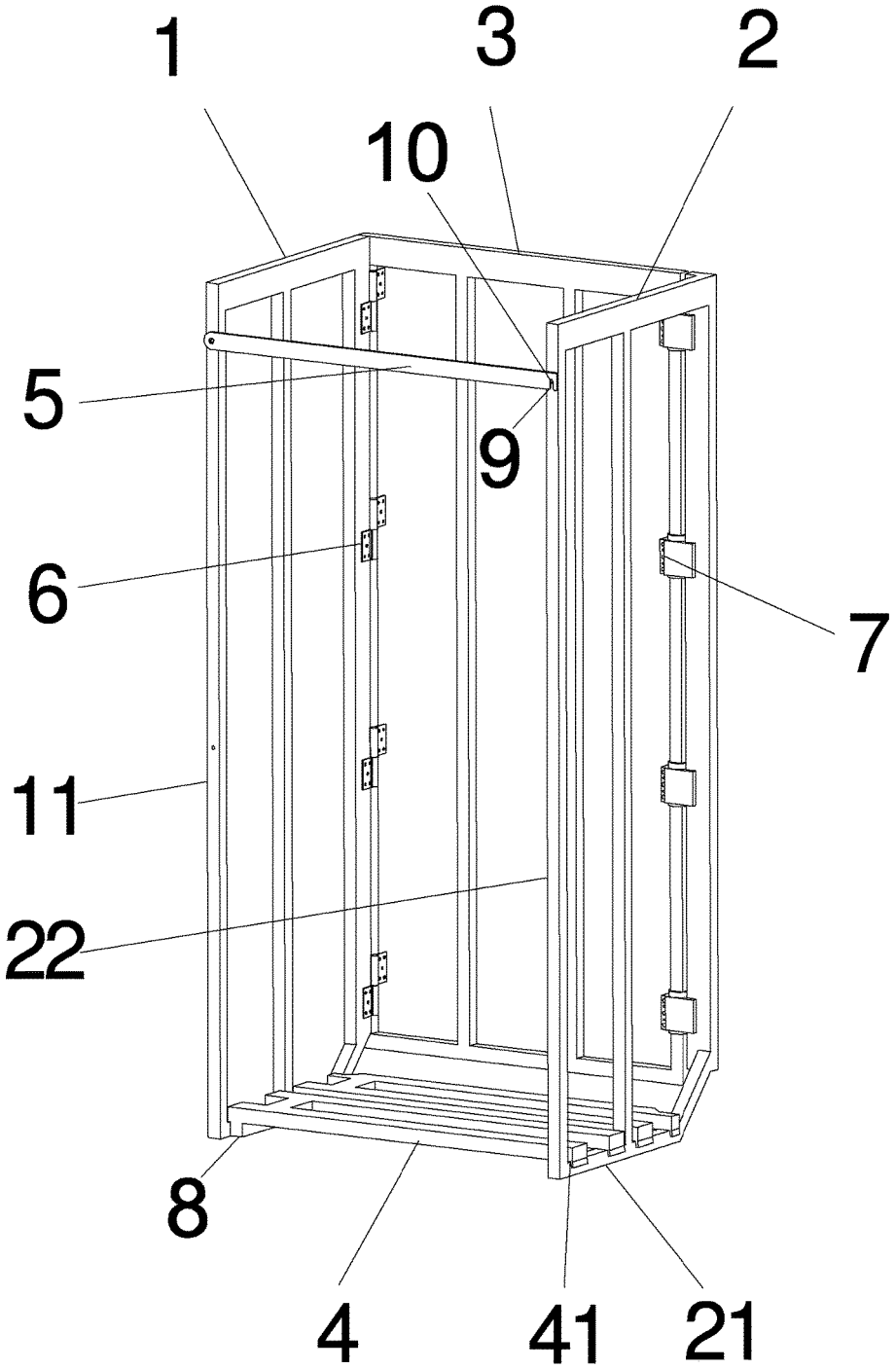
FIG. 1 is a schematic view of the structure of the folding cargo container according to the present utility model.
Figure 2:
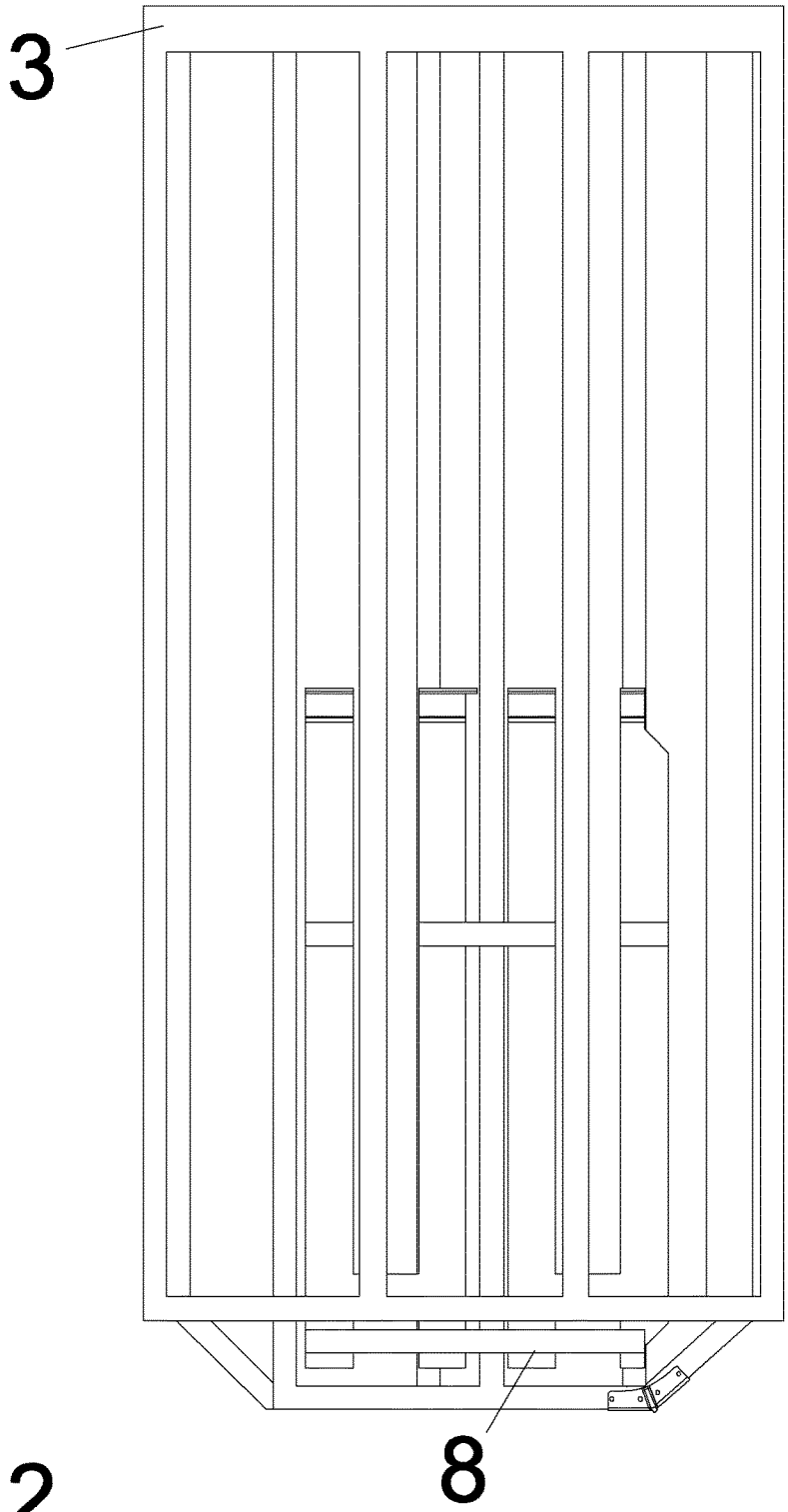
FIG. 2 is a schematic view, from the rear, of the structure of FIG. 1 when folded.

FIGS. 1-2, illustrate one example embodiment of the inventive folding cargo container, unfolded and folded, respectively. The cargo container comprises a left frame 1, a right frame 2, a rear frame 3, a bottom frame 4, a cross bar 5, a first connection member 6, a second connection member 7, and a third connection member 8. The left frame 1 is foldably connected to the rear frame 3 via the first connection member 6. The right frame 2 is foldably connected to the rear frame 3 via the second connection member 7. The left end of the bottom frame 4 is foldably connected to the left frame 1 via the third connection member.

As shown, the right end of the bottom frame 4 is formed to connect with locking slots 41, that lock the bottom frame 4 to the rail 21 on the bottom of the right frame.

The left end of the cross bar 5 is rotatably connected to the left frame 1. The right end of the cross bar 5 is provided with a latching slot 9, and the right frame 2 is provided with a latching pin 10 for engagement with the latching slot 9.

The embodiment of FIGS. 1-2 mainly comprises a left frame 1, a right frame 2, a rear frame 3, a bottom frame 4, a cross bar 5, a first connection member 6, a second connection member 7, and a third connection member. The illustrated structure is therefore simple, and the production cost is low.

As shown, the cross bar 5 of FIG. 1 may rotate and can be disengaged from the latching pin 10 by rotation.

In addition, the bottom frame 4 may be folded to the left frame 1 by rotating by 90 degrees via the third connection member 8. Likewise, the left frame 1 may be folded to the rear frame 3 by rotating by 90 degrees via the first connection member 6, and, in similar fashion, the right frame 2 may be folded to the rear frame 3 by rotating by 90 degrees via the second connection member 7. As a result, the cargo container may be folded when not in use, which takes up less space.

As shown, the foldable connection is between the left end of the bottom frame 4 and the left frame 1 via the third connection member 8. In an alternative embodiment, the bottom frame 4 may use the right end of the bottom frame 4 for foldable connection to the right frame 2 via the third connection member 8, which can also achieve the same folding effect, which is a mirror image of FIG. 1 in this regard.

With some implementations, the left frame 1, the right frame 2, the rear frame 3, and the bottom frame 4 may be an aluminum alloy. Likewise, the cross bar 5 may be an aluminum alloy rod. This is because aluminum alloy has high strength, light weight and is simple to manufacture. Naturally, a user may also select other materials, as long as they meet the requirements of high strength and lightweight.

In the embodiment of FIGS. 1-2, the first connection member 6, the second connection member 7, and the third connection member 8 are hinges. Hinges are common connection members, which have a simple structure, small size, and low cost. Naturally, a user may also select other devices as the connection members, as long as they can achieve the effects of rotation, connection and folding as described herein.

In some embodiments, the folding cargo container may further comprise a top frame (not shown) that is connected in a similar manner to either the left frame 1 or right frame 2 such that the top frame can be foldably connected to the left frame 1 or the right frame 2 depending upon the hinge location.

Finally, as shown in FIG. 1, the left end of the cross bar 5 is rotatably connected to a front vertical rod 11 of the left frame, and the latching pin 10 is disposed on the front vertical rod 22 of the right frame. With still other embodiments, as an alternative to the rotatable connection of the left end to the left frame 1, the cross bar 5 may use its right end for the rotatable connection to the right frame 2, in which case, the latching pin 10 will be disposed on the left frame 1 (i.e., it will be a mirror image of what is shown in FIG. 1).

What is claimed is:

1. A folding cargo container, comprising:

a left frame;

a right frame;

a rear frame;

a bottom frame;

a cross bar;

a first connection member;

a second connection member; and a third connection member;

wherein, the left frame is foldably connected to the rear frame via the first connection member;

wherein, the right frame is foldably connected to the rear frame via the second connection member;

wherein, an end of the bottom frame is connected to the third connection member and is foldably connected to one of the left frame or right frame via the third connection member;

wherein, the bottom frame is further formed to lock onto the bottom of one of the left or right frames via an end that is opposite the third connection member;

wherein, the cross bar is rotatably connected, at one end, to one of the left frame or the right frame and an opposite end of the cross bar is provided with a latching slot; and wherein, one of the left frame or right frame to which the cross bar is not rotatably connected is provided with a latching pin thereon to allow for engagement by the latching slot of the cross bar when the left frame and right frame are unfolded.

2. The folding cargo container of claim 1, wherein the first connection member, the second connection member, and the third connection member are hinges.

3. The folding cargo container of claim 1, wherein the first connection member, second connection member and third connection member are moveable through a range of 90°.

4. The folding cargo container of claim 1, wherein the left frame, right frame, rear frame and bottom frame comprise an aluminum alloy.

5. The folding cargo container of claim 1, wherein the cross bar comprises an aluminum alloy.

6. The folding cargo container of claim 1, wherein the third connection member connects the bottom frame to the left frame.

7. The folding cargo container of claim 6, wherein the locking slots lock the bottom frame to the right side.

8. The folding cargo container of claim 1, wherein the third connection member connects the bottom frame to the right frame.

9. The folding cargo container of claim 7, wherein the locking slots lock the bottom frame to the left frame.

10. The folding cargo container of claim 1, wherein the cross bar is rotatably connected to the left frame.

11. The folding cargo container of claim 1, wherein the cross bar is rotatably connected to the right frame.

* * * * *